United States Patent [19]

Rex

[11] 4,074,860

[45] Feb. 21, 1978

[54] SPRING RAIL CLAMP

[76] Inventor: Albert Edward Rex, 38 Halifax Street, Adelaide, South Australia, Australia

[21] Appl. No.: 721,274

[22] Filed: Sept. 8, 1976

[30] Foreign Application Priority Data

Apr. 6, 1976 Australia ..... 5511/76
Apr. 15, 1976 Australia ..... 5617/76

[51] Int. Cl.[2] ..... E01B 9/04; E01B 9/62
[52] U.S. Cl. ..... 238/349; 238/351
[58] Field of Search ..... 238/310, 315, 331, 333, 238/338, 349, 351, 354

[56] References Cited

U.S. PATENT DOCUMENTS

| | | | |
|---|---|---|---|
| 2,167,870 | 8/1939 | Boyce | 238/351 |
| 3,451,621 | 6/1969 | Splinter | 238/315 |
| 3,517,883 | 6/1970 | Holstein | 238/349 |
| 3,610,526 | 10/1971 | Burwell | 238/310 |
| 3,887,128 | 6/1975 | Ruble | 238/349 |

FOREIGN PATENT DOCUMENTS

| | | | |
|---|---|---|---|
| 985,512 | 3/1965 | United Kingdom | 238/351 |

*Primary Examiner*—Robert J. Spar
*Assistant Examiner*—Carl Rowold
*Attorney, Agent, or Firm*—Jay L. Chaskin

[57] ABSTRACT

A rail clip for securing a rail to a tie wherein there is a shoulder upstanding from the tie having an aperture extending through it in a longitudinal direction, the shoulder containing a pin of general U-shape which bears downwardly intermediate the ends of a resilient plate-like clip which in turn bears downwardly against the rail foot and the tie.

8 Claims, 8 Drawing Figures

SPRING RAIL CLAMP

This invention relates to means for the securing of a rail to rail support means (for example a railroad tie or a rail base plate when carried on a railroad tie), and the invention further extends to the method of securing the rail to the rail support means, and to a rail tie assembly.

In the specification which accompanied my U.S. application Ser. No. 637,533, filed Dec. 4, 1975 a rail cleat (or clip) was described and claimed the main object of which was to apply a restraining force against a rail foot and retain it in firm engagement with a tie or base plate, locate the rail for guage, but be sufficiently resilient to avoid development of rubbing surfaces and consequential wear. Another object was to provide an assembly quickly and easily effected, or dis-assembled without the need of specialised equipment. The clip described and claimed comprised a spring plate having a configuration which, when retained at an intermediate locality, a rail bearing end bore against the upper surface of a rail foot while a tail bore against a tie or a base plate, or a bearing pad on either of them, there being provided an upstanding loop extending upwardly from the tie, and a locking pin passing through the loop and bearing against an intermediate locality of a clip so as to urge the clip downwardly against the foot of the rail.

This invention is a further development of the above invention.

BACKGROUND OF THE INVENTION

One type of rail clip which has been used previously utilises a shoulder embedded in a concrete sleeper, the shoulder having a shoulder lug projecting therefrom. The shoulder lug is provided with a longitudinally extending aperture, the aperture being partly surrounded by a circularly curved surface which extends away from the rail into a bearing shelf, and a rod-like retaining member bears against the bearing shelf and also bears against the rail foot, the downward force being achieved by flexure of the rod-like member.

An object of this invention is to provide an improved rail clip wherein used can be made of existing shoulders and wherein plate-like clips can be applied to an existing railroad.

In this invention the rail clip is resilient and plate-like engaged by clip retaining means carried by the shoulder lug and applying downward pressure intermediate its ends thereby deflecting the intermediate portion of the clip downwardly and applying consequential downward pressure on the toe of the clip which in turn applies a downward pressure on the rail foot. The clip retaining means can be a very simple device so that the advantages of a plate-like clip can be applied to an existing railroad.

When a rail is utilised as portion of an electrical circuit, it is necessary to insulate the rail from the supporting ties, and this is normally done with a rail insulating pad. However a rail insulating pad is liable to be damaged if very high bearing pressures are applied as for example by the use of a rod type of spring clip, and a further object of this invention is to provide a clip which can employ a relatively wide bearing surface against a rail insulating pad so that the danger of damage to the pad is reduced.

An insulating pad of relatively resilient material is less liable to damage than a relatively brittle pad, but also deflects more under load. Upon deflection there is a loss of pressure retaining the rail to the tie, and possibility of relative movement which is deleterious.

The main object of this invention is to provide means whereby pressure is retained on the rail foot notwithstanding loss of height of insulating pad, or the use of wide manufacturing tolerances, while at the same time providing means for retention of rail gauge.

BRIEF DESCRIPTION OF THE INVENTION

Briefly in this invention there is provided rail securing means comprising a shoulder lug which is upstanding from rail support means, for example a tie, a resilient plate-like clip having a toe and a heel, and retaining means which engage the shoulder lug and apply a downward pressure to the clip intermediate its ends so as to apply pressure to the toe and heel of the clip which in turn applies pressure to the rail foot.

One great advantage of this invention is that it enables standard and well proven engineering principles to be applied to rail fastening means, and in many instances these improvements can be applied on track. More specifically, where steel ties are used, it becomes possible to secure the shoulder lugs to the steel ties or base plates after the rails have been positioned, by means of a stud welding machine, the rail lugs being secured by a stud welding process, and therefore the invention further includes, in combination, a railroad tie having at least four shoulder lugs thereon, the shoulder lugs being affixed thereto by the process of welding, the railroad tie being arranged to support a pair of rails positioned between adjacent pairs of lugs, each lug having a clip secured thereto, the clip being in accordance with the above definition.

Still further, the invention extends to include a method of securing rails to rail support means which comprises forming steel ties, welding at least four shoulder lugs to each tie, positioning rails between adjacent pairs of shoulder lugs, positioning respective clips over the shoulder lugs, and securing the clips thereto with retaining means which engage the shoulder lugs and also engage the clips intermediate their ends, thereby applying a downwardly force against the rail foot, with each clip, each said clip and each said shoulder lug being in accordance with the above definition.

BRIEF DESCRIPTION OF THE DRAWINGS

An embodiment of the invention is described hereunder in some detail with reference to and as illustrated in the accompanying drawings in which.

Figure 1:
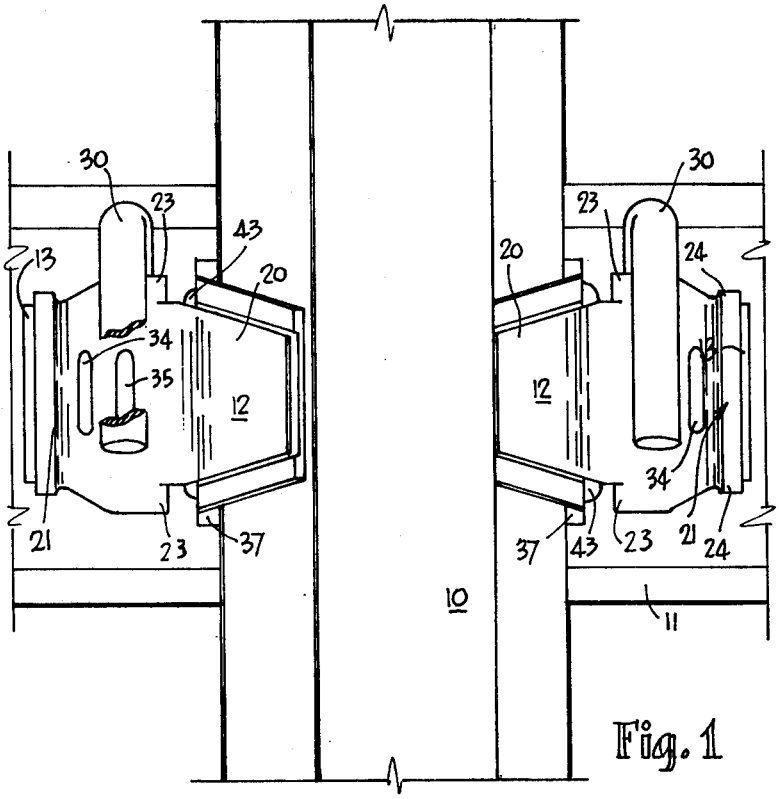
FIG. 1 is a plan view illustrating a rail secured on each side of a tie.

Referring first to the embodiment of FIG. 1 through to 5, a rail 10 is secured to a steel tie 11 (or to a rail anchor when carried on the tie) by means of a pair of clips 12 one on each side of the rail 10.

The tie 11 has secured to it four shoulder lugs 13 (two of which are shown) which are secured by a process known in the art as "stud welding" wherein an electrical current is applied between the work pieces and aluminium also between the work pieces is caused to burn under the heat generated, imparting further heat to the weld metal which is subsequently forged by pressure between the work pieces. This is a well known technique and frequently used in the welding of studs, bolts or the like to steel girders and other structural members. Each shoulder lug 13 is provided with a longitudinally extending aperture 16 which is surrounded by a circularly formed outer wall 16 terminating in an extension 17 extending away from the rail, and having a bearing surface 18 thereon.

Each clip 12 is formed from spring steel plate, the end designated 20 being a toe which applies a downward pressure on the foot of the rail and the end designated 21 being a heel which applies a downward pressure on the bearing surface 18 of shoulder 13. Each clip 12 is provided with lugs designated 23 which are contiguous with respective side surfaces of the shoulder, and a pair of lugs 24 which straddle the shoulder 13 as best seen in FIG. 1. The tongues 23 are contiguous with respective end surfaces of lugs 13, but the tongues 23 also engage respective retaining pins 30 to reduce possibility of displacement of the clips 12.

Each retaining pin 30 is of U-shape or "hairpin" shape, and has an aperture engaging arm 31 and a clip engaging arm 32, the clip engaging arm 32 having a downwardly formed portion 33 which bears against the walls of a depression 34 in the clip 12. This reduces danger of dis-lodgement of the retaining pin 30 and also of the dis-lodgement of the clip 12. The combination of the resilience of the retaining pin 30 and the plate resilience of the clip 12 provides means whereby a relatively minor loss of pressure occurs as wear takes place on the resilient pads. A second depression 35 is circumferentially displaced from depression 34 in the clip 12 and provides an alternative land for the portion 33 so that the pressure against the rail foot can be varied, the distances of the depressions 34 and 35 from the centre of aperture 15 being different.

Figure 2:
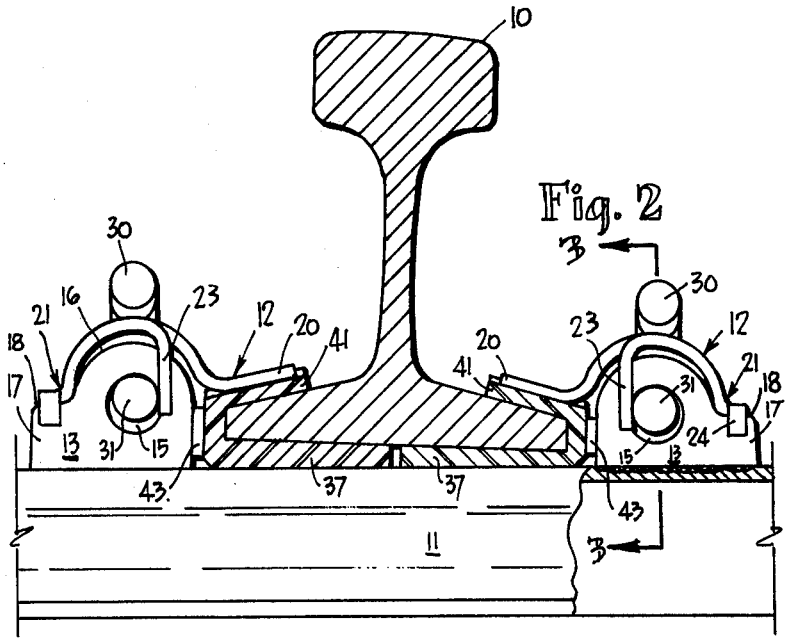
FIG. 2 is a fragmentary section through same.
Figure 3:
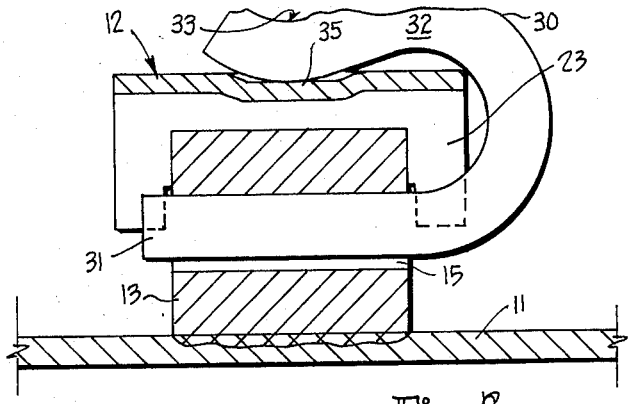
FIG. 3 is a section taken on line 3—3 of FIG. 2.
Figure 4:
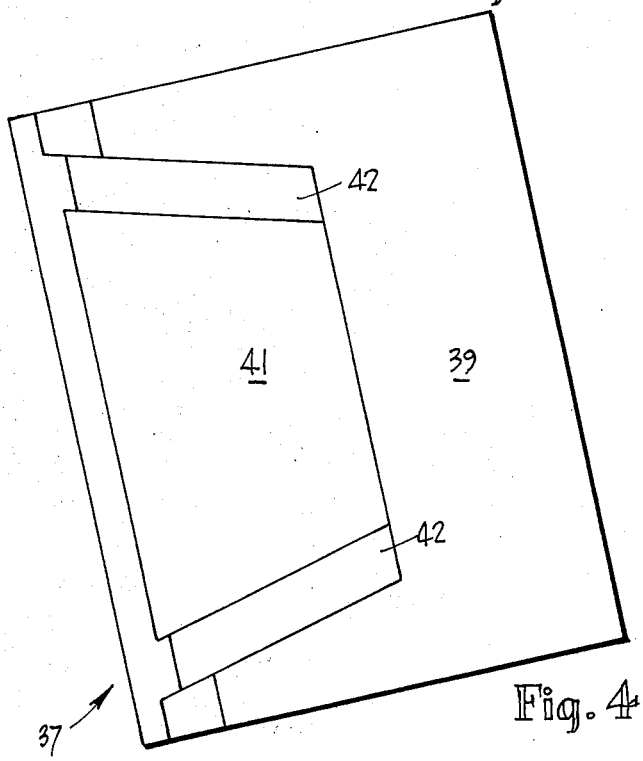
FIG. 4 is a plan view of a rail insulating pad.
Figure 5:
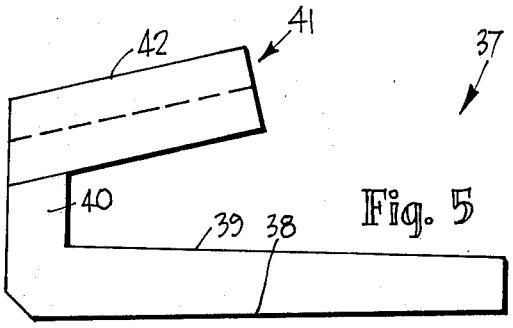
FIG. 5 is an elevation of same.

For the purpose of electrically insulating the rails from the ties, and also of absorbing some at least of the shock imparted to the rails as rolling stock passes over them, and still further for the purpose of providing a cant for the rails, the rails have resilient pads interposed between them and the ties, there being one resilient pad at the location of each clip. The pads are designated 37 and are formed of electrically insulating polymeric material, the configuration being separately shown in FIGS. 4 and 5. Each pad 30 has a tie engaging surface designated 38 and a rail foot support surface 39, the surfaces 38 and 39 defining a lower portion of the pad which tapers in thickness so as to provide the cant for the rail 10 as best seen in FIG. 2. The pad has an upwardly extending web 40 and a return upper portion 41 which bears against the upper surface of the rail foot as shown in FIG. 2. The portion 41 terminates at its side edges in upstanding flanges 42 which are positioned one each side of the clip 12 which engages it thereby reducing the possiblity of longitudinal displacement of the pad. In order to avoid lateral displacement, packing means is provided between the shoulder lug 13 and the outer edge of the pad 37, in this embodiment being a U-shaped strip 43.

Figure 6:
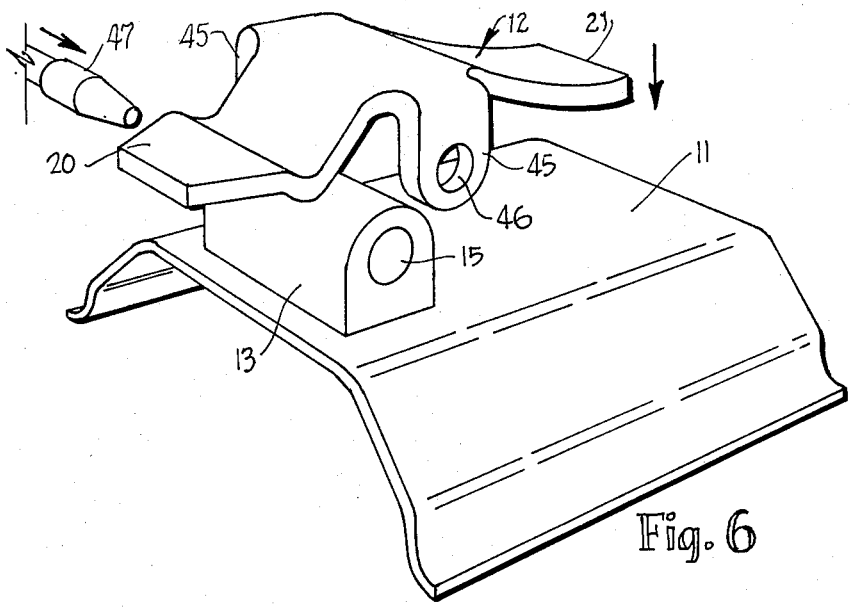
FIG. 6 is a fragmentary view illustrating an alternative clip arrangement.

While there is some advantage to be achieved by having the additional resilience of the retaining pin 30, in some embodiments this is deemed to be not necessary, and for example in the second embodiment of FIG. 6, the tie 11 is provided with a shoulder lug 13 as before, and similar parts are similarly designated with similar item numbers. However in this embodiment the clip 12 is provided with two depending flanges designated 45 which are contiguous with the end walls of the shoulder lug 13, each depending flange 45 containing an aperture 46, and as illustrated in FIG. 6 a waisted pin 47 extends between the apertures 15 and 46 when they are aligned, to apply the required downward force to the clip 12.

Figure 7:
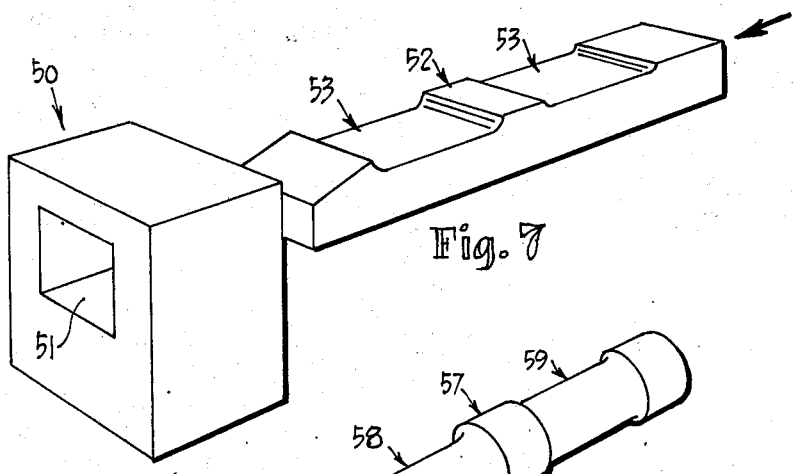
FIG. 7 is an alternative arrangement for the shoulder lug and pin assembly.
Figure 8:
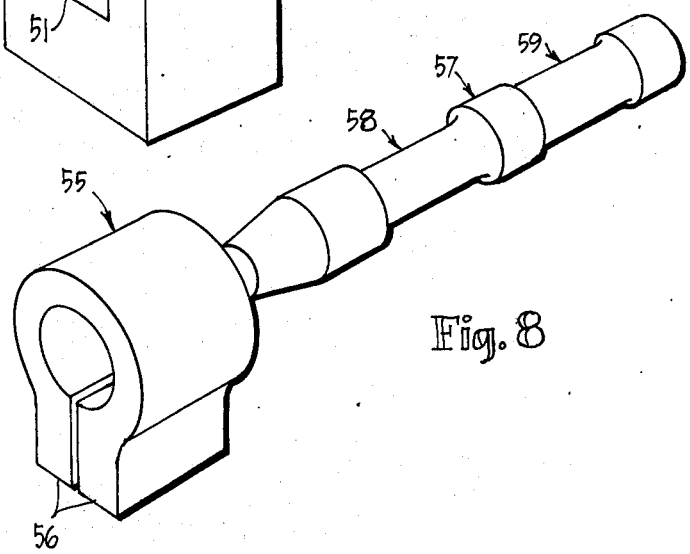
FIG. 8 is a still further alternative shoulder lug and pin assembly.

By use of welding techniques which are available the configuration of the shoulder lug 13 can be varied considerably and for example in FIG. 7 the shoulder lug is designated 50 and is provided with a rectangular aperture 51 which is arranged to receive a rectangular pin 52 having a pair of depression portions 53 therein which give means for applying varying pressures to the plate like clip 12. Stud welding is sometimes improved if the areas to be welded are reduced, and in the embodiment of FIG. 8 the lug designated 55 is formed from flat steel folded over to an eye shape, the welding taking place on the end faces 56, and use being made of a circular section retaining pin 57, again with two waisted portions 58 and 59 which are of different diameter.

If the waisted portions 58 and 59, or the depression portions 53 are selectively used, bearing presures can be applied to the clip, and for example after wear has taken place on a pad, it is merely necessary to drive the retaining pin in further so that the larger diameter waisted portion becomes operative.

Although the invention necessarily extends to rail base plates since there are many rail base plates in use which can have secured thereto shoulder lugs in accordance with this invention, nevertheless the invention is capable of avoiding the use of base plates on new work with the consequential considerable saving in cost.

Various modifications in structure and function are possible in the disclosed embodiments by one skilled in the art without departing from the scope of the invention as defined by the claims.

I claim:

1. Rail securing means for the securing of a rail to rail support means which has a reaction surface fixed with respect to said rail support means, comprising a shoulder lug secured to and upstanding from the support means alongside the rail, a retaining aperture through the shoulder lug extending in the longitudinal direction of the rail, a resilient plate-like clip having a toe at one end, a heel at the other end, a depression in its upper surface intermediate its ends, the upper surface being disposed above the retaining aperture, a pin of general U-shape having one leg extending through said aperture and the other leg engaging said depression, said pin also being resilient and applying a downward pressure to said clip intermediate its ends thereby deflecting the intermediate portion of the clip downwardly and applying consequential downward pressures on both the toe and the heel, the toe of the clip bearing downwardly against the rail foot thereby securing the rail to its support means and the heel of the clip bearing downwardly against said reaction surface.

2. Rail securing means according to claim 1 wherein the clip has two depressions therein spaced from one another and one leg of the pin is provided with a downwardly formed portion which selectively engages the depressions, one depression being spaced further from said retaining aperture than the other thereby causing greater deflection of the clip when engaged by the pin than when said other depression is engaged by the pin.

3. Rail securing means according to claim 1 wherein the clip is of curved shape intermediate its ends, and has a pair of depending lugs which straddle said shoulder lug and are contiguous with its side surfaces.

4. Rail securing means according to claim 3 wherein said shoulder leg has a bearing surface which is engaged by the heel of the clip.

5. Rail securing means according to claim 1 further comprising a rail insulating pad the under surface of which is a tie engaging surface which, with a rail foot engaging surface, defines a lower portion, the rail insulating pad having an upwardly extending web and a return upper portion which bears against the upper surface of a rail foot, the return portion terminating at its side edges in upstanding flanges, said toe of the clip bearing against the upper return portion between the upstanding flanges.

6. Rail securing means according to claim 5 wherein said upper surface and said rail foot engaging surface are both flat surfaces but are not parallel to one another, thereby applying a cant of the rail when supported by said lower portion of the pad.

7. Rail securing means for the securing of a rail to rail support means which has a reaction surface fixed with respect to said rail support means, comprising a shoulder lug secured to and upstanding from the support means alongside the rail, a retaining aperture through the shoulder lug extending in the longitudinal direction of the rail, a resilient plate-like clip having a toe and a heel, a pair of depending flanges respectively contiguous with opposite sides of the shoulder lug, and an aperture in each respective flange, and a pin extending through said flange and apertures and bearing against its walls and also through said shoulder lug retaining aperture applying a downward pressure to said clip intermediate its ends thereby deflecting the intermediate portion of the clip downwardly and applying consequential downward pressures on both toe and heel, the toe of the clip bearing downwardly against the rail foot thereby securing the rail to its support means and the heel of the clip bearing downwardly against said reaction surface.

8. A method of securing a pair of rails to a tie comprising stud welding two pairs of shoulder lugs to the tie in such postion that they locate said rails with respect to the tie when rails are positioned between the lugs of the respective pairs, each shoulder having a bearing surface extending in a direction away from the foot of the rail to be located thereby, each shoulder by having and an aperture extending therethrough in a direction parallel to the longitudinal direction of said rails, positioning lower portions of a pair of rail insulating pads on the tie, each said pad having a pair of upwardly extending webs each with a return portion, positioning rails on respective said lower portions and said return portions on the respective upper surfaces of the foot of the rails, engaging said respective plate-like clips over said respective lugs, said clips having toes positioned on respective said pad return portions and heels positioned on said shoulder lug upper surfaces, and positioning one leg of a U-shaped pin through the aperture of each respective shoulder lug, and the other leg over the respective plate like clip to bear downwardly thereon and thereby apply downward pressure on the respective rail foot.

* * * * *